US007828410B2

(12) United States Patent
Watanabe et al.

(10) Patent No.: US 7,828,410 B2
(45) Date of Patent: Nov. 9, 2010

(54) INK-JET RECORDING APPARATUS

(75) Inventors: Hidetoshi Watanabe, Tokoname (JP); Atsuo Sakaida, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 789 days.

(21) Appl. No.: 11/747,381

(22) Filed: May 11, 2007

(65) Prior Publication Data

US 2007/0263029 A1 Nov. 15, 2007

(30) Foreign Application Priority Data

May 11, 2006 (JP) ..... 2006-132136

(51) Int. Cl.
*B41J 2/165* (2006.01)
*B41J 23/00* (2006.01)

(52) U.S. Cl. ..... 347/33; 347/20; 347/22; 347/29; 347/30; 347/32; 347/35; 347/36

(58) Field of Classification Search ..... 347/30, 347/32, 33, 35
See application file for complete search history.

(56) References Cited

U.S. PATENT DOCUMENTS

| | | | | |
|---|---|---|---|---|
| 4,306,245 | A | 12/1981 | Kasugayama et al. | |
| 4,340,897 | A * | 7/1982 | Miller | 347/33 |
| 5,432,539 | A * | 7/1995 | Anderson | 347/33 |
| 5,557,306 | A * | 9/1996 | Fukushima et al. | 347/33 |
| 5,870,116 | A * | 2/1999 | Kyoshima | 347/33 |
| 5,949,448 | A * | 9/1999 | Man et al. | 347/33 |
| 6,158,839 | A * | 12/2000 | Fukushima et al. | 347/33 |
| 6,238,035 | B1 * | 5/2001 | Barinaga | 347/28 |
| 6,530,643 | B1 * | 3/2003 | Askren et al. | 347/33 |
| 6,652,062 | B2 | 11/2003 | Umeyama et al. | |
| 7,182,428 | B2 * | 2/2007 | Le Gallo | 347/33 |
| 2001/0020963 | A1 * | 9/2001 | Fukushima et al. | 347/33 |
| 2005/0264601 | A1 * | 12/2005 | Park | 347/33 |

FOREIGN PATENT DOCUMENTS

| | | | |
|---|---|---|---|
| JP | H55-0101461 | A | 8/1980 |
| JP | H58-025966 | A | 2/1983 |
| JP | H10-217492 | A | 8/1998 |
| JP | 2001277521 | A | 10/2001 |
| JP | 2004142101 | A | 5/2004 |
| JP | 2005074671 | A | 3/2005 |

OTHER PUBLICATIONS

Japanese Office Action issued in corresponding Japanese Application No. 2006-132136, dated Apr. 21, 2008.

* cited by examiner

*Primary Examiner*—Ryan Lepisto
(74) *Attorney, Agent, or Firm*—Baker Botts L.L.P.

(57) ABSTRACT

An ink-jet recording apparatus includes a brush, a suction unit, and a wiper. The brush brushes off matters adhering to an ink ejection face of an ink-jet head. The suction unit sucks the matters brushed off by the brush. The wiper has a contact face to be brought into contact with the ink ejection face to remove matters adhering to the ink ejection face. A brush moving mechanism is provided for moving the brush in parallel with the ink ejection face. A wiper moving mechanism is provided for moving the wiper in parallel with the ink ejection face. The wiper moving mechanism can move the wiper with bringing the contact face of the wiper into contact with the ink ejection face. A controller of the ink-jet recording apparatus controls the brush, the suction unit, and the wiper.

11 Claims, 8 Drawing Sheets

INK-JET RECORDING APPARATUS

CROSS-REFERENCE TO RELATED APPLICATIONS

This application claims the benefit the benefit of Japanese Patent Application No. 2006-132136, filed May 11, 2006, the disclosure of which is incorporated herein by reference in its entirety.

BACKGROUND OF THE INVENTION

1. Field of the Invention

The present invention relates to an ink-jet recording apparatus, in particular, including an ink-jet head on which ink ejection ports are formed.

2. Description of Related Art

In some ink-jet recording apparatuses, an ink-jet head having an ink ejection face on which ink ejection ports are formed is provided with a wiper for eliminating matters adhering to the ink ejection face. The wiper has functions of eliminating extraneous matters and excessive ink, which are adhering to the ink ejection face, and stably keeping meniscuses. However, when a large amount of matters are adhering to the ink ejection face, the wiper may not fully remove the adhering matters from the ink ejection face. In addition, wiping by the wiper may cause a trouble that some ink ejection ports are stopped by extraneous matters and the meniscuses can not stably be kept.

For the above reason, an apparatus disclosed in Japanese Patent Unexamined Publication No. 2005-74671 includes a brush for brushing off adhering matters from the ink ejection face before wiping by the wiper. Because the wiper wipes the ink ejection face after adhering matters are brushed off from the ink ejection face to a certain extent, the adhering matters are surely removed from the ink ejection face and the meniscuses are stably kept.

In the apparatus disclosed in the above Publication, however, the brush merely gets dirty due to ink and extraneous matters brushed off from the ink ejection face. Therefore, many times of cleanings of the ink ejection face with the brush lead to cleaning of the ink ejection face with the dirty brush. As a result, the ink ejection face does not become clean.

SUMMARY OF THE INVENTION

An object of the present invention is to provide an ink-jet recording apparatus in which the effect of cleaning an ink ejection face does not easily decrease even after cleaning with a brush is performed many times.

According to the present invention, an ink-jet recording apparatus comprises an ink-jet head having an ink ejection face on which a plurality of ejection ports for ejecting ink are formed; and a brush that brushes off matters adhering to the ink ejection face. The brush comprises a plurality of bristles and a brush main body on which the plurality of bristles are fixed. The apparatus further comprises a suction unit that sucks matters brushed off by the brush; a wiper having a contact face that is to be brought into contact with the ink ejection face to remove matters adhering to the ink ejection face; a brush moving mechanism that moves the brush in parallel with the ink ejection face; a wiper moving mechanism that moves the wiper in parallel with the ink ejection face with bringing the contact face of the wiper into contact with the ink ejection face; a brush suction controller that controls the brush moving mechanism to move the brush to brush off adhering matters from the ink ejection face, and controls the suction unit to suck the adhering matters; and a wiper controller that controls the wiper moving mechanism to move the wiper with bringing the contact face of the wiper into contact with the ink ejection face.

According to the invention, adhering matters brushed off are sucked by the suction unit. Therefore, adhering matters such as extraneous matters and ink are hard to remain on and near the brush. This prevents the ink ejection face from being contaminated by adhering matters remaining on and near the brush.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter, a preferred embodiment of the present invention will be described with reference to FIGS. 1 to 8.

Figure 1:
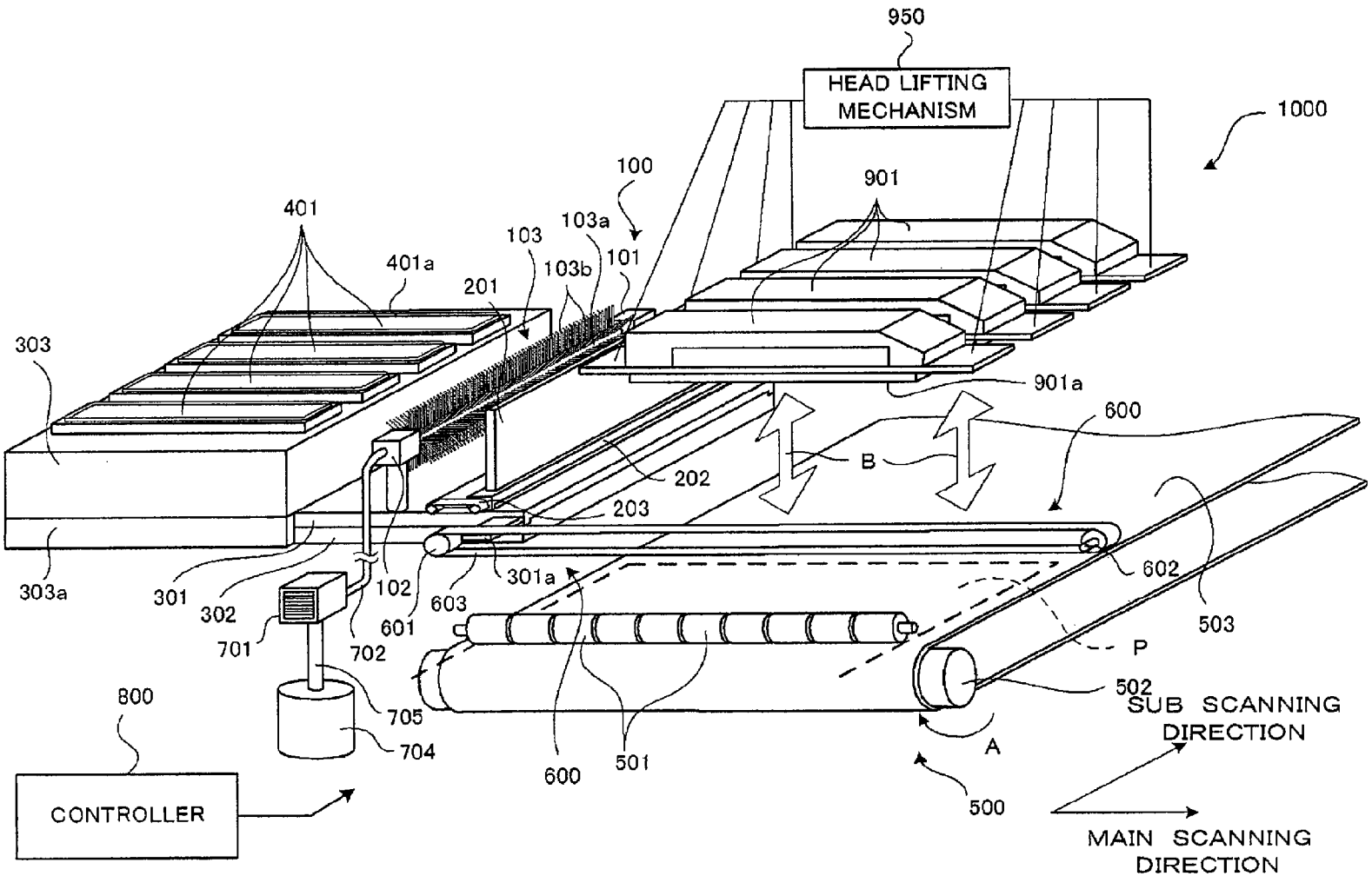
FIG. 1 shows a general construction of an ink-jet printer according to an embodiment of the present invention.

An ink-jet printer 1000 includes a conveyance mechanism 500 for conveying a printing paper P. The conveyance mechanism 500 includes feed rollers 501, a pair of conveyance rollers 502, and a conveyor belt 503. FIG. 1 shows only one of the conveyance rollers 502. The other conveyance roller 502 is disposed at a position horizontally distant in a sub scanning direction from the conveyance roller 502 shown in FIG. 1. Either of the conveyance rollers 502 is long in a main scanning direction. One of the conveyance rollers 502 is driven by a not-shown driving mechanism to rotate in a direction A shown in FIG. 1. The other conveyance roller 502 is supported in the printer 1000 so as to be rotatable in the direction A.

In this specification, the sub scanning direction corresponds to the conveyance direction of printing papers, that is, the direction from the front toward the back of FIG. 1. The main scanning direction is horizontally perpendicular to the sub scanning direction, that is, rightward in FIG. 1. The directions "upward" and "downward" are upward and downward in FIG. 1, respectively.

The conveyor belt 503 is an endless belt wrapped on the pair of conveyance rollers 502. Of two broad surfaces of the conveyor belt 503, the surface not in contact with the conveyance rollers 502 serves as a conveyance surface for printing papers P. When the conveyance rollers 502 rotate, the conveyor belt 503 runs on and between the conveyance rollers 502 in accordance with the rotations of the conveyance rollers 502.

The conveyance mechanism 500 includes a number of feed rollers 501 arranged in series in the main scanning direction. Over the conveyance roller 502 shown in FIG. 1, each feed roller 501 is supported on a rotational axis extending in the main scanning direction, so as to be rotatable around the rotational axis. Not-shown biasing means is biasing the feed rollers 501 downward toward the conveyance surface of the conveyor belt 503.

A printing paper P is conveyed by the conveyance mechanism 500 as follows. When the leading edge of the printing paper P reaches the feed rollers 501, the printing paper P is nipped by the feed rollers 501 and the conveyor belt 503. In this state, the printing paper P is conveyed in the sub scanning direction by the conveyor belt 503 running. When the printing paper P has passed the feed rollers 501, the printing paper P adhering to the conveyance surface of the conveyor belt 503 is conveyed in the sub scanning direction with the running conveyor belt 503.

The printer 1000 includes four ink-jet heads 901. In a plan view, each ink-jet head 901 has a generally rectangular shape extending in the main scanning direction. The ink-jet heads 901 are disposed at the same vertical level and at the same position in the main scanning direction. The ink-jet heads 901 are arranged at predetermined intervals in the sub scanning direction.

The lower face of each ink-jet head 901 is formed into a nozzle face 901*a* as an ink ejection face on which a large number of nozzles as ink ejection ports are formed. The nozzle face 901*a* is horizontal and flat. The nozzle face 901*a* is opposed to the conveyance surface of the conveyor belt 503. Ink passages are formed in each ink-jet head 901. One ends of the ink passages are connected to the respective nozzles formed on the nozzle face 901*a*. The other ends of the ink passages are connected to a not-shown ink supply port formed on the upper face of the ink-jet head 901. The ink supply ports of the respective ink-jet heads 901 are connected to not-shown ink tanks, which store therein inks of different colors for the respective ink-jet heads 901.

Both ends of each ink-jet head 901 are fixed to a head lifting mechanism 950. The head lifting mechanism 950 moves each ink-jet head 901 vertically, that is, in the directions shown by a double-headed allow B, to change the distance between the nozzle face 901*a* of the ink-jet head 901 and the upper conveyance surface of the conveyor belt 503.

The printer 1000 includes a movable table 301, a fixed table 302, and a cap table 303. These are tables for supporting a brush unit 100, a wiper blade 201, and head caps 401, as will be described later. Any of the tables has a horizontal upper face. The fixed table 302 has a flat board shape. It is horizontally fixed in the printer 1000. The movable table 301 is put on the fixed table 302 so as to be movable forward and backward in the main scanning direction. The cap table 303 is put on the movable table 301.

The cap table 303 is provided with a fixing mechanism 303*a* for fixing the cap table 303 to one of the movable and fixed tables 301 and 302. The fixing mechanism 303*a* can selectively take two states, that is, a state wherein the cap table 303 is fixed to the movable table 301 and a state wherein the cap table 303 is fixed to the fixed table 302. Thus, when the fixing mechanism 303*a* is in the former state, the cap table 303 can move forward and backward in the scanning direction together with the movable table 301. On the other hand, when the fixing mechanism 303*a* is in the latter state, the cap table 303 does not move even when the movable table 301 moves, and the cap table 303 stays at a position at which the cap table 303 has been fixed to the fixed table 302.

Figure 2A:
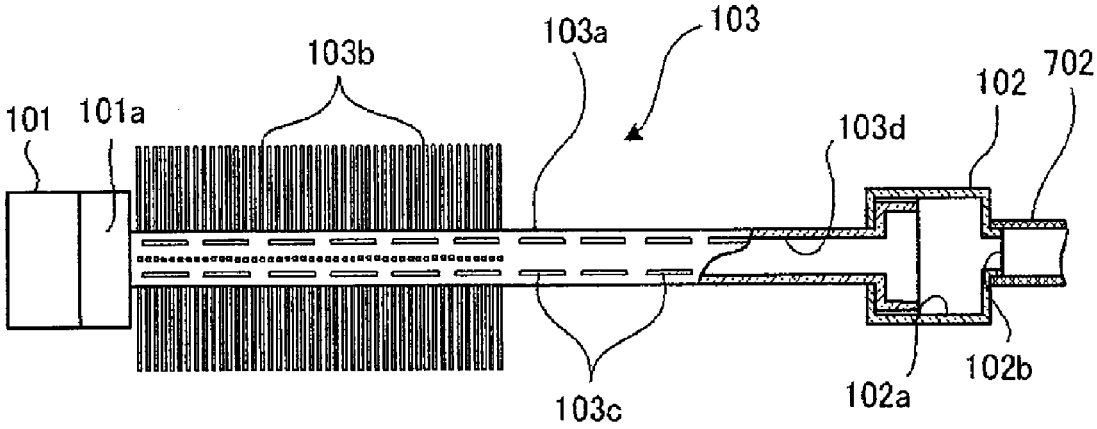
FIG. 2A is a partially sectional upper view of a brush unit shown in FIG. 1.

The printer 1000 includes a brush unit 100, a wiper blade 201, and four head caps 401. The brush unit 100 includes a brush 103 and brush supports 101 and 102. The brush 103 has a brush main body 103*a* and a large number of bristles 103*b* fixed to the brush main body 103*a*. The brush main body 103*a* has a cylindrical shape extending in the sub scanning direction. Both ends of the brush main body 103*a* are supported by the brush supports 101 and 102 on the movable table 301. The brush support 101 is provided with a drive motor 101*a* as first and second rotary drive mechanisms as shown in FIG. 2A. The drive shaft of the drive motor 101*a* is fixed to one end of the brush main body 103*a*. The other end of the brush main body 103*a* is supported by the brush support 102 so as to be freely rotatable. When the drive motor 101*a* operates, the brush 103 rotates around a rotational axis extending in the sub scanning direction.

The wiper blade 201 has a rectangular shape whose long sides extend in the sub scanning direction and whose short sides extend vertically. The wiper blade 201 is made of an elastic material such as rubber. The wiper blade 201 is formed to stand on a wiper blade table 202. The wiper blade table 202 is disposed on the movable table 301 so as to be movable forward and backward in the main scanning direction on the movable table 301.

The head caps 401 are fixed to the upper face of the cap table 303. In a plan view, each head cap 401 has a generally rectangular shape extending in the sub scanning direction. A protrusion 401*a* protruding upward is formed on the upper face of each head cap 401. The protrusion 401*a* is made of an elastic material such as rubber. The protrusion 401*a* is formed so as to surround the upper face of the head cap 401. In a plan view, each protrusion 401*a* has a rectangular shape extending in the sub scanning direction. The size of the protrusion 401*a* has been adjusted so as to be able to surround a region of the nozzle face 901*a* of the corresponding ink-jet head 901 where nozzles are formed. The head caps 401 are disposed at the same position in the main scanning direction. The head caps 401 are arranged in the sub scanning direction at the same intervals as the ink-jet heads 901. The intervals between the head caps 401 have been adjusted so that the protrusion 401*a* of each head cap 401 can surround, in a plan view, the region of the nozzle face 901*a* of the corresponding ink-jet head 901 where nozzles are formed when the four ink-jet heads 901 and the four head caps 401 are put to vertically overlap each other.

The printer 1000 includes a movable table driving mechanism 600 for moving the movable table 301. The movable table driving mechanism 600 includes a slave roller 601, a drive roller 602, and a drive belt 603. The slave and drive rollers 601 and 602 are horizontally distant from each other in the main scanning direction. Either of the slave and drive rollers 601 and 602 is supported in the printer 1000 so as to be rotatable around a rotational axis extending in the sub scanning direction. The drive roller 602 is driven by a not-shown drive mechanism to rotate. The drive belt 603 is wrapped on the slave and drive rollers 601 and 602. A protrusion 301*a* is formed on a side face of the movable table 301 extending in the main scanning direction, so as to protrude in a direction opposite to the sub scanning direction. The protrusion 301*a* is fixed to the drive belt 603. When the drive roller 602 rotates, the drive belt 603 runs on and between the slave and drive rollers 601 and 602. Thereby, the movable table 301 moves forward or backward in the main scanning direction because the protrusion 301*a* is fixed to the drive belt 603.

The printer 1000 includes a wiper blade moving mechanism 203, as an on-table moving mechanism, for moving the wiper blade table 202. The wiper blade moving mechanism 203 has a similar construction to that of the movable table driving mechanism 600. That is, the wiper blade moving mechanism 203 includes two rollers and an endless belt wrapped on the rollers. The endless belt is fixed to the wiper blade table 202. When the rollers rotate, the endless belt runs. Thereby, the wiper blade table 202 moves forward or backward in the main scanning direction.

The printer 1000 includes a suction unit 701. A fan is disposed in the suction unit 701. A suction port and an exhaust port are formed on the suction unit 701. The suction port is connected to the brush support 102 through a tube 702. The exhaust port is exposed to the exterior of the printer 1000. A waste tank 704 is connected to the lower face of the suction unit 701 through a pipe 705. When the fan of the suction unit 701 rotates, air in the brush support 102 is sucked through the tube 702 and the suction port and then discharged through the exhaust port to the exterior of the printer 1000.

As shown in FIG. 2A, a large number of suction holes 103*c* are formed on the brush main body 103*a*. A cavity 103*d* is formed in the brush main body 103*a*. FIG. 2A shows only some of the bristles 103*b*. FIG. 2A shows a partially sectional view of the brush main body 103*a* and a sectional view of the brush support 102 and the tube 702. Each suction hole 103*c* is formed to extend from the outer surface 6*f* the brush main body 103*a* to the cavity 103*d*. A cavity 102*a* is formed in the brush support 102. One end of the brush main body 103*a* is supported by the brush support 102 so as to be freely rotatable and connect the cavity 103*d* to the cavity 102*a*. An opening 102*b* of the cavity 102*a* is formed on the brush support 102. The tube 702 is connected to the opening 102*b*.

In this construction, when the suction unit 701 sucks air from the brush support 102, atmospheric air near the brush 103 is sucked through the suction holes 103*c* formed on the brush main body 103*a* into the cavity 103*d*, and finally discharged to the exterior of the printer 1000. At this time, extraneous matters and ink adhering to the brush 103 are sucked with the air through the suction holes 103*c*, and finally discharged into the waste tank 704 through the pipe 705.

Figure 2B:
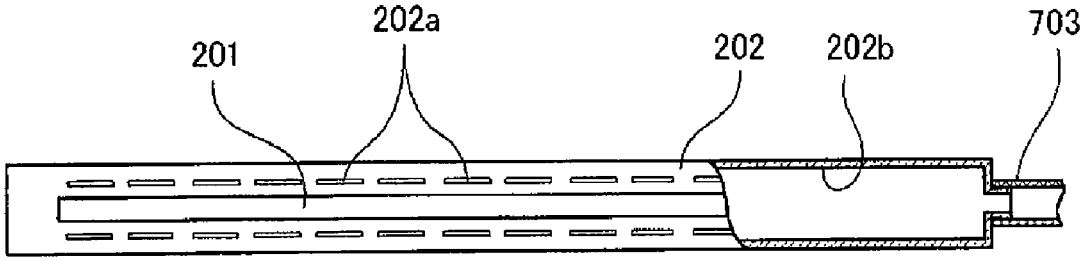
FIG. 2B is a partially sectional upper view of a wiper blade shown in FIG. 1.

As shown in FIG. 2B, a cavity 202*b* is formed in the wiper blade table 202. A large number of suction holes 202*a* are formed on the wiper blade table 202 to be connected to the cavity 202*b*. A tube 703 is connected to one end of the wiper blade table 202. The cavity 202*b* is connected to the interior of the tube 703. A suction unit similar to the suction unit 701 is connected to the other end of the tube 703. Extraneous matters and ink adhering to the wiper blade 201 are sucked by the suction unit through the suction holes 202*a*, the cavity 202*b*, and the tube 703.

Figure 3:
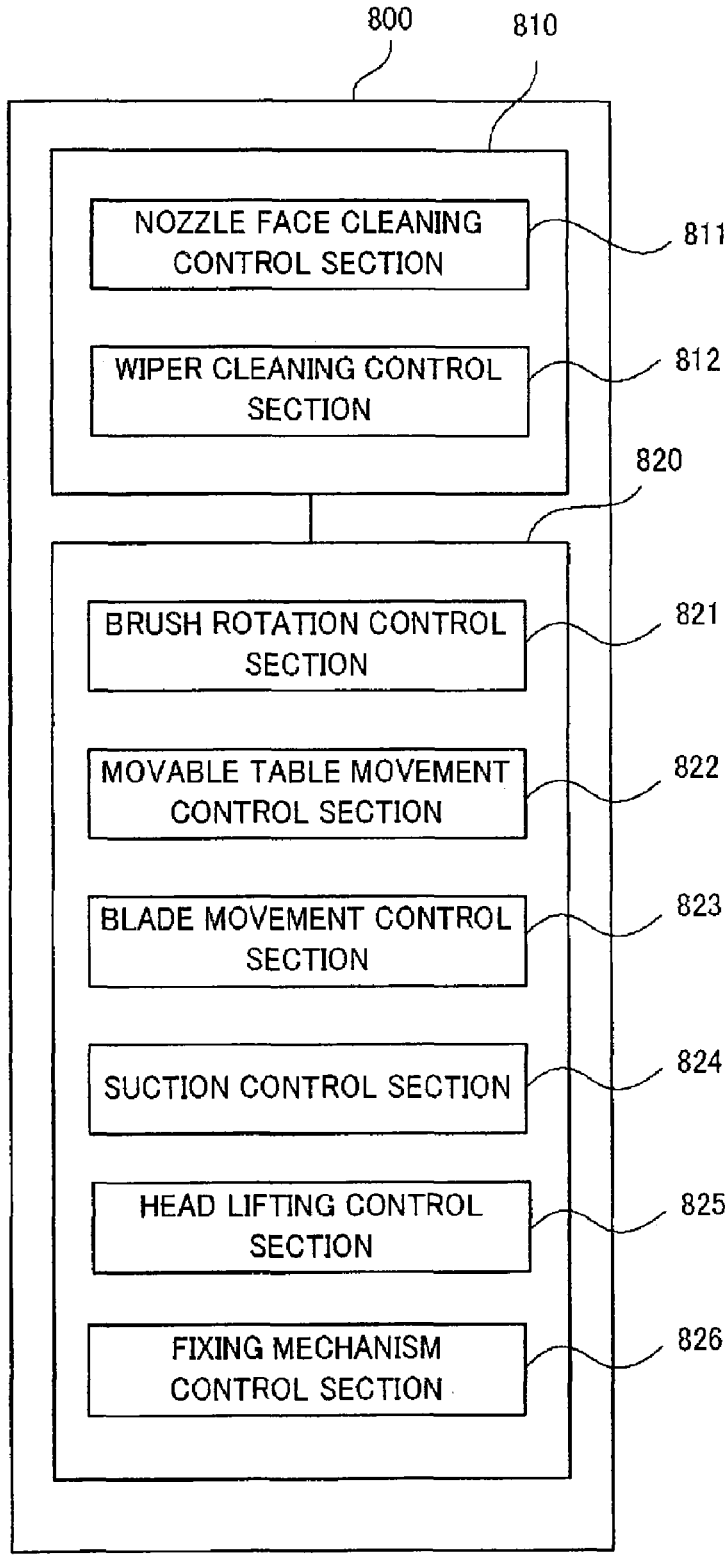
FIG. 3 is a block diagram showing a functional constitution of a controller shown in FIG. 1.

As shown in FIG. 3, the controller 800 includes a main control unit 810 and a sub control unit 820. The printer 1000 includes therein various kinds of hardware components including a central processing unit (CPU) and memory devices such as a read only memory (ROM) and a random access memory (RAM) The memory devices store therein various kinds of software programs including programs that cause the above hardware components to function as the controller 800. In a modification, such programs may be stored in a removable type storage medium such as a CD-ROM, an FD, or an MO. Combinations of the above hardware components and the above software programs realize the following functions of the controller 800.

The sub control unit 820 follows instructions from the main control unit 810 to control the rotation of the brush 103, the movement of the movable table 301, and so on. The sub control unit 820 includes a brush rotation control section 821, a movable table movement control section 822, a blade movement control section 823, a suction control section 824, a head lifting control section 825, and a fixing mechanism control section 826.

The brush rotation control section 821 drives or stops the drive motor 101*a* disposed on the brush support 101 to make the brush 103 rotate or to stop the rotation of the brush 103. The movable table movement control section 822 controls the driving mechanism for driving the drive roller 602 to move the movable table 301 forward or backward in the main scanning direction by an arbitrary distance. The blade movement control section 823 controls the wiper blade moving mechanism 203 to move the wiper blade table 202 on the movable table 301 forward or backward in the main scanning direction by an arbitrary distance.

The suction control section 824 controls the suction unit 701 or the suction unit connected to the wiper blade table 202 to suck extraneous matters and ink adhering to the brush 103 or the wiper blade 201 into the corresponding suction unit. The head lifting control section 825 controls the head lifting mechanism 950 to vertically move the ink-jet heads 901. The fixing mechanism control section 826 switches over the fixing mechanism 303*a* between the state wherein the cap table 303 is fixed to the movable table 301 and the state wherein the cap table 303 is fixed to the fixed table 302.

The main control unit 810 includes a nozzle face cleaning control section 811 and a wiper cleaning control section 812. The nozzle face cleaning control section 811 sends to the sub control unit 820 an instruction for controlling to make the brush 103 and the wiper blade 201 clean the nozzle face 901*a* of each ink-jet head 901. Following the instruction, the sub control unit 820 controls the brush 103, the wiper blade 201 and so on to clean the nozzle face 901*a*. The wiper cleaning control section 812 sends to the sub control unit 820 an instruction for controlling to make brush 103 clean the wiper blade 201. Following the instruction, the sub control unit 820 controls the brush 103 and so on to clean the wiper blade 201. In this case, the wiper cleaning control section 812 and the sub control unit 820 serve as a wiper cleaning controller. Such an instruction to be sent from the main control unit 810 to the sub control unit 820 contains timings of start and stop, the direction of movement, and the quantity of movement for the rotation of the brush 103, the movement of the movable table 301, the vertical movement of the ink-jet heads 901, the suction operation of a suction unit such as the suction unit 701, and so on.

In addition, the controller 800 controls each ink-jet head 901 to eject ink, and the head lifting mechanism 950 and so on to put the head caps 401 on the respective ink-jet heads 901. Further, the controller 800 controls the conveyance mechanism 500 to convey a printing paper. Thus, the controller 800 performs general control for the operation of each part of the printer 1000.

Next, an ink ejection operation, a nozzle face cleaning operation, a cap putting operation, and a wiper cleaning operation will be described with reference to FIGS. 4 to 8. In FIGS. 4 to 8, for simplifying the figures, the suction unit 701, the movable table driving mechanism 600, and so on, are omitted.

First, an ink ejection operation will be described with reference to FIG. 4. The controller 800 controls the head lifting mechanism 950 to keep the ink-jet heads 901 at a position where the nozzle faces 901*a* are at a predetermined small distance from the upper face of the conveyance mechanism 500, that is, the conveyance surface. The controller 800 then controls the conveyance mechanism 500 to convey a printing paper, and controls each ink-jet head 901 to eject ink. Thus, an image is formed on the printing paper.

During the above operation, the movable table 301 is kept at a withdrawal position out of a region opposed to the ink-jet heads 901 and the conveyor belt 503. As shown in FIG. 4, the withdrawal position of the movable table 301 is provided on the left side of the ink-jet heads 901 when viewed in the conveyance direction. At this time, the cap table 303 is fixed to the fixed table 302, and the wiper blade table 202 is distant from the brush unit 100. In this embodiment, the wiper blade table 102, the brush unit 100, and the cap table 303 are disposed in this order from the ink-jet heads 901.

A nozzle face cleaning operation will be described with reference to FIGS. 5 and 6. After a predetermined time elapses from the completion of ink ejection from the ink-jet heads 901, cleaning of the nozzle faces 901*a* is started. Note that cleaning of the nozzle faces 901*a* may be started at any timing in an ink non-ejection period in which any ink-jet head 901 does not eject ink.

Figure 4:
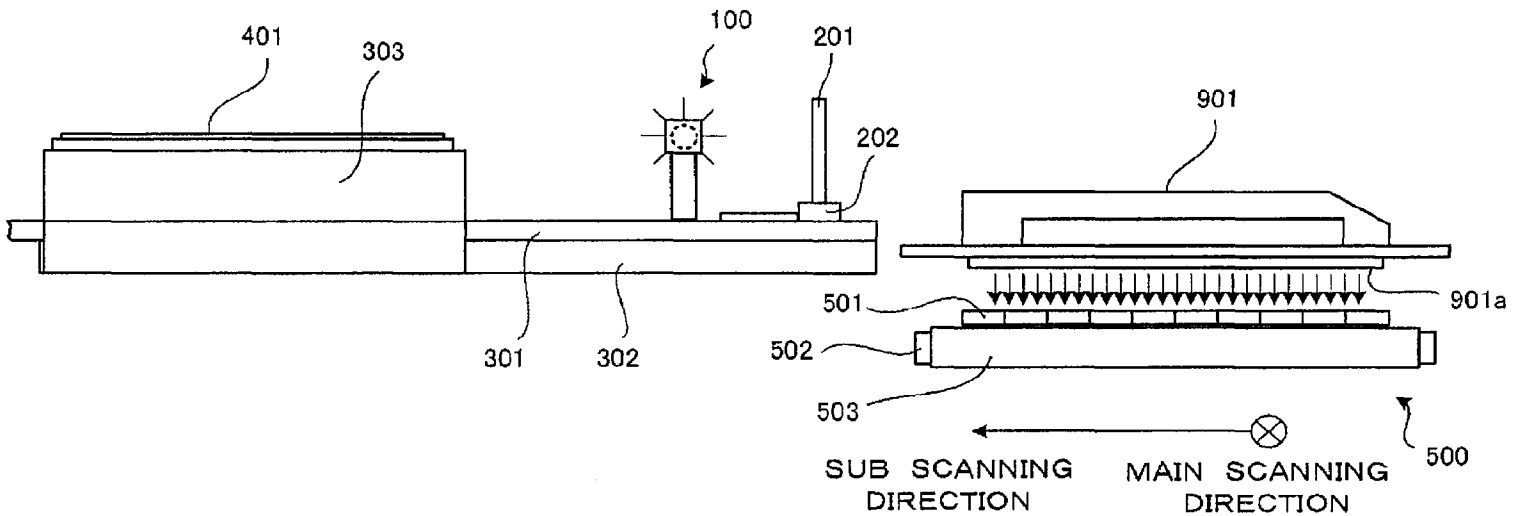
FIG. 4 shows an ink ejection operation of the ink-jet printer of FIG. 1.
Figure 5:
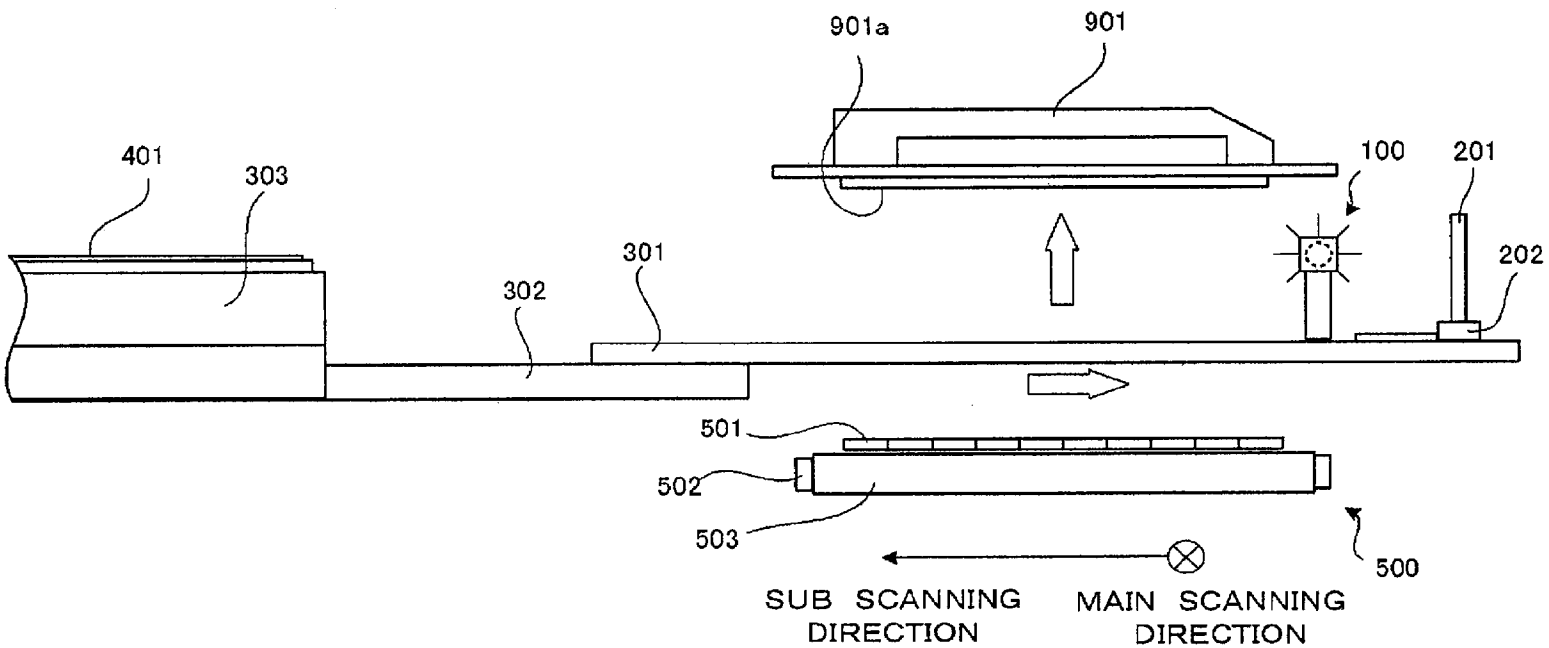
FIG. 5 shows the ink-jet printer that is changing from the state shown in FIG. 4 into a state of cleaning a nozzle face of an ink-jet head.

First, as shown in FIG. 5, the controller 800 controls the head lifting mechanism 950 to lift up the ink-jet heads 901 from the position shown in FIG. 4 to a position upper than the brush unit 100 and the wiper blade 201. The controller 800 then controls the movable table driving mechanism 600 to move the movable table 301 so that the brush unit 100 is moved to the right side of the nozzle faces 901*a*. After the brush unit 100 reaches a predetermined right position, the controller 800 controls the head lifting mechanism 950 to move down the ink-jet heads 901 to a maintenance position as shown in FIG. 6. In the maintenance position, the brush 103 and the upper end, that is, the contact portion, of the wiper blade 201 can be in contact with the nozzle face 901*a*. In the operation of FIGS. 5 and 6, the controller 800 controls the fixing mechanism 303*a* so that only the movable table 301 is moved.

After the controller 800 controls the head lifting mechanism 950 to move down the ink-jet heads 901, the controller 800 controls the drive motor 101*a* to start the brush 103 to rotate, and controls the suction unit 701 and the suction unit connected to the wiper blade table 202 to start their suction operations.

Figure 6:
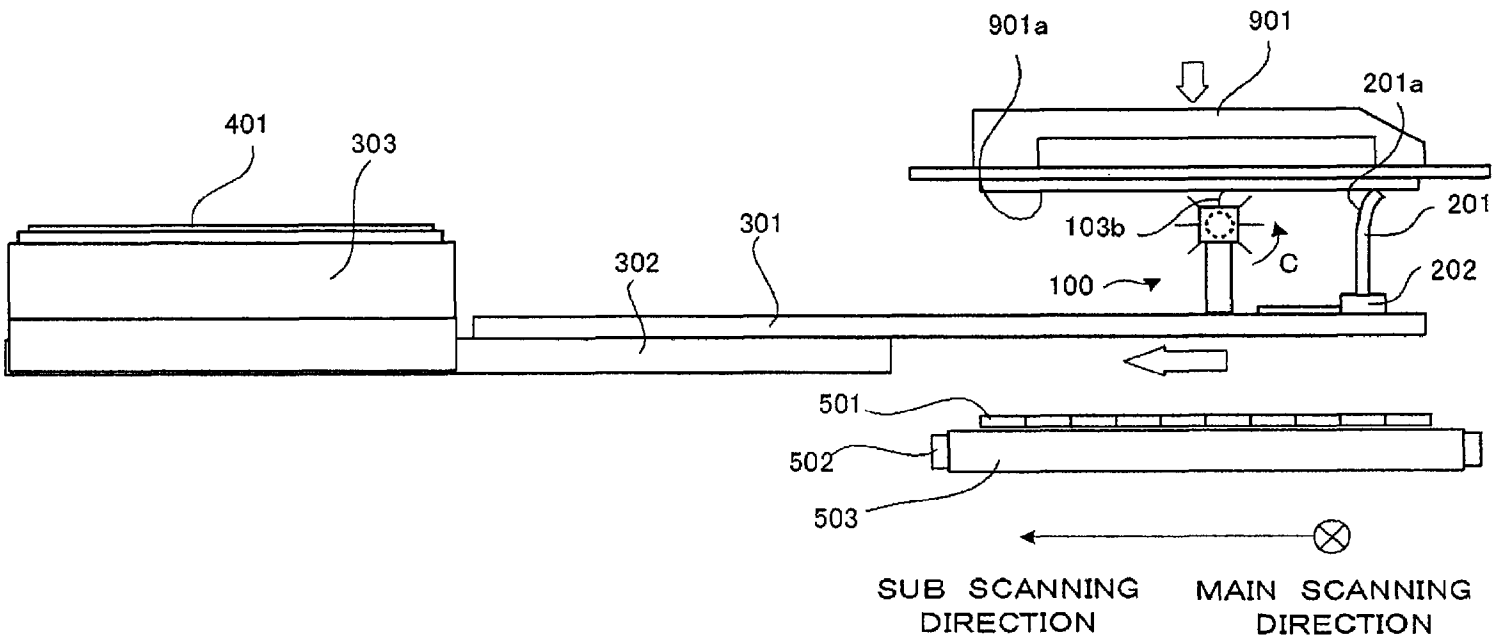
FIG. 6 shows the ink-jet printer after the state shown in FIG. 5, in which the nozzle face of the ink-jet head is being cleaned.

As shown in FIG. 6, the controller 800 then controls the movable table driving mechanism 600 to move the movable table 301 leftward so that the brush unit 100 and the wiper blade 201 pass over the whole area of each nozzle face 901*a*. At this time, the upper ends of the bristles 103*b* sweep the nozzle face 901*a* in the direction C, and a portion near the upper end of the wiper blade 201 moves leftward with being in contact with the nozzle face 901*a*. Thereby, over the whole area of the nozzle face 901*a*, the bristles 103*b* brush off adhering matters and the contact face 201*a* of the wiper blade 201 removes adhering matters. Further, extraneous matters and ink brushed off by the bristles 103*b* and having dropped from the wiper blade 201 are sucked by the suction unit 701 and the like.

The controller 800 then controls the movable table driving mechanism 600 to move back the movable table 301 to the position shown in FIG. 4, and stops the rotation of the brush 103 and the suction operations of the suction unit 701 and the like. Thus, cleaning of the nozzle faces 901*a* is completed. Cleaning of the nozzle faces 901*a* is performed at least one time in an ink non-ejection period. Therefore, cleaning to keep meniscuses uniform is always performed before the ink-jet heads 901 eject ink.

Figure 7:
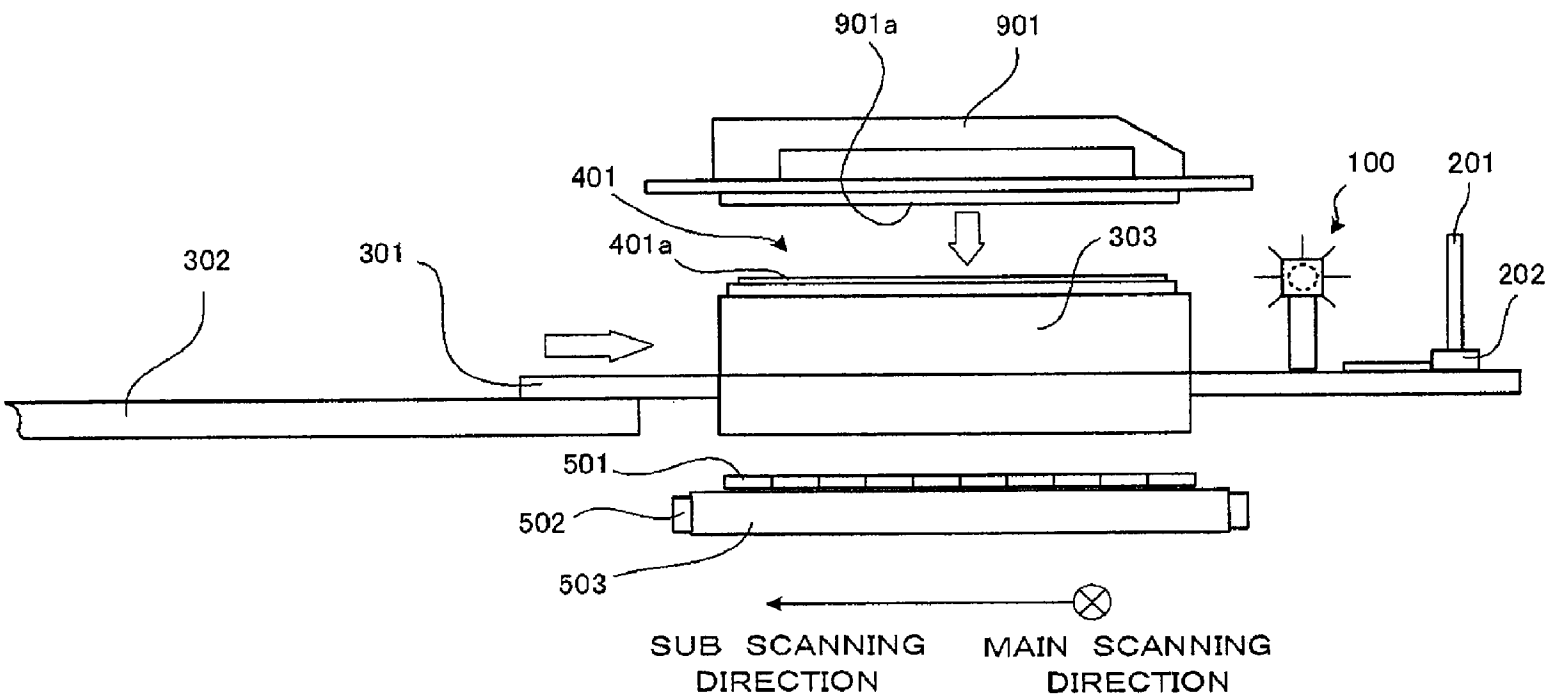
FIG. 7 shows the ink-jet printer in which a head cap is being put on the nozzle face of the ink-jet head.

A cap putting operation will be described with reference to FIG. 7. The cap putting operation is carried out when the power of the printer 1000 is switched from on to off. For example, when the power of the printer 1000 in the state shown in FIG. 4 is switched from on to off, the controller 800 controls the head lifting mechanism 950 to lift up the ink-jet heads 901 to a position upper than the brush unit 100 and the wiper blade 201. The controller 800 then controls the fixing mechanism 303*a* so that the cap table 303 is fixed to the movable table 301. The controller 800 then controls the movable table driving mechanism 600 to move the movable table 301 rightward to a position where the protrusion 401*a* formed on each head cap 401 surround all nozzles formed on the corresponding nozzle face 901*a*, in a plan view. At this time, as shown in FIG. 7, the brush unit 100 and the wiper blade 201 are moved together with the cap table 303. Afterward, as shown in FIG. 7, the controller 800 controls the head lifting mechanism 950 to move down the ink-jet heads 901 to a position where the upper end of each protrusion 401*a* is in contact with the corresponding nozzle face 901*a*. The power of the printer 1000 is then switched off. Thus, during the power-off period, each nozzle face 901*a* is covered with the corresponding head cap 401. Therefore, the nozzles formed on each nozzle face 901*a* is protected so that the meniscuses are hard to dry.

Figure 8A:
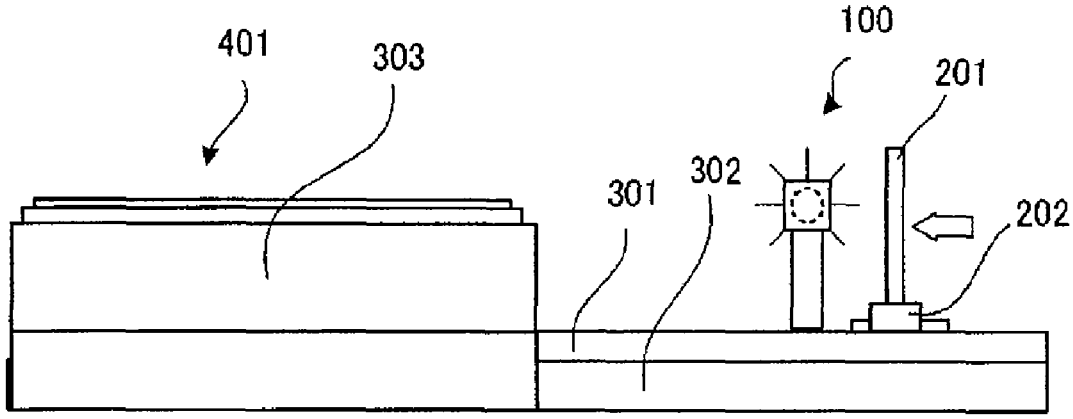
FIGS. 8A and 8B show an operation of cleaning the wiper blade with the brush unit.
Figure 8B:
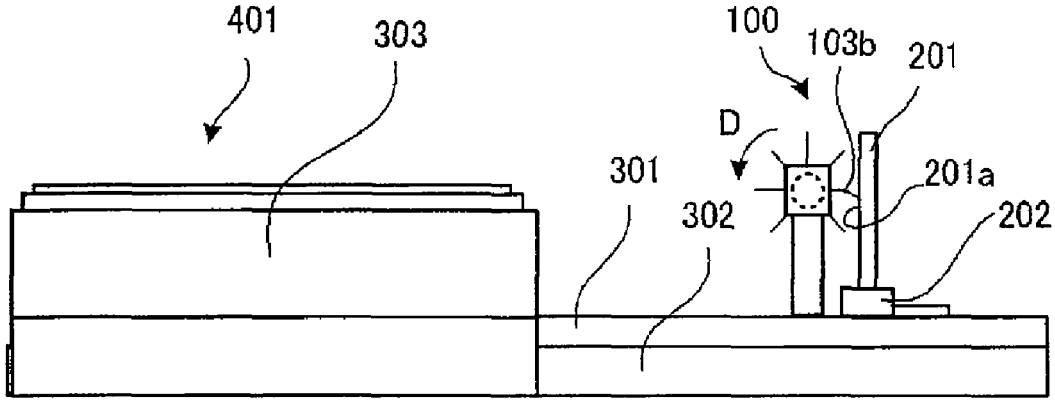

A wiper cleaning operation will be described with reference to FIGS. 8A and 8B. Cleaning of the wiper blade 201 is started from the state shown in FIG. 4. First, the controller 800 controls the wiper blade moving mechanism 203 to move the wiper blade table 202 leftward to a position where the right end of the bristles 103*b* of the brush unit 100 comes into contact with the wiper blade 201. The controller 800 then controls the drive motor 101*a* to make the brush 103 rotate in a direction D. Further, the controller 800 controls the suction unit connected to the wiper blade table 202 and the suction unit 701 to suck adhering matters on the brush and adhering matters on the wiper blade table 202. Thus, adhering matters on the surface of the wiper blade 201 is brushed off by the bristles 103*b*, and extraneous matters and ink brushed off by the bristles 103*b* and having dropped from the wiper blade 201 are sucked by the suction units such as the suction unit 701.

The wiper cleaning operation is carried out irrespective of whether or not the ink-jet heads 901 are ejecting ink. That is, cleaning of the wiper blade 201 is performed in a state in which the wiper blade 201 is not opposed to the nozzle faces 901*a*, as shown in FIG. 4. Therefore, the wiper cleaning operation does not hinder ink ejection from any ink-jet head 901. Thus, cleaning of the wiper blade 201 can be performed even while the ink-jet heads 901 are ejecting ink.

It is, however, preferable that such a wiper cleaning operation is performed at least one time before the movable table 301 is moved to the cleaning position for a nozzle face cleaning operation. Thereby, the cleaned wiper blade 201 is used for cleaning the nozzle faces 901*a*. As a result, when the wiper blade 201 wipes each nozzle face 901*a* in the nozzle face cleaning operation, extraneous matters are prevented from being brought into nozzles of the nozzle face 901*a*. It is also preferable that a wiper cleaning operation is performed immediately after a nozzle face cleaning operation. Immediately after cleaning of each nozzle face 901*a*, ink remaining on the wiper blade 201 is kept in liquid form without being dried. Therefore, the ink can easily be removed by the brush 103 and thus the wiper blade 201 is surely cleaned.

In this embodiment, in a nozzle face cleaning operation, the suction units such as the suction unit 701 suck extraneous matters and ink brushed off by the brush 103 and having dropped from the wiper blade 201. This prevents each nozzle face 901*a* from being cleaned with the brush 103 and the wiper blade 201 that have been contaminated by ink and extraneous matters. As a result, each nozzle face 901*a* can be kept clean.

In addition, both of the brush unit 100 and the wiper blade 201 are disposed on the movable table 301. Therefore, the brush unit 100 and the wiper blade 201 can be operated in conjunction with each other by a simple construction.

In this embodiment, the operation of a wiper moving mechanism is realized by a combination of operations of the head lifting mechanism 950 and the movable table driving mechanism 600. That is, the head lifting mechanism 950 moves the ink-jet heads 901 to the maintenance position, and then the movable table driving mechanism 600 moves the movable table 301 so that the wiper blade 201 is moved along the nozzle faces 901*a* with being in contact with the nozzle faces 901*a*. On the other hand, the operation of a wiper controller corresponds to an operation of the controller 800 to control the head lifting mechanism 950 and the movable table driving mechanism 600 in a nozzle face cleaning operation. Further, the operation of a brush suction controller corresponds to an operation of the controller 800 to control the rotation of the brush 103, the movement of the movable table 301, and the suction operation of the suction unit 701 in a nozzle face cleaning operation.

<Modifications>

Modifications of the above-described embodiment will be described in the above-described embodiment, the brush unit 100 is fixed to the movable table 301 and the wiper blade 201 is moved. In a modification, however, the wiper blade 201 may be fixed and the brush unit 100 may be moved.

In the above-described embodiment, each ink-jet head 901 is fixed in the main scanning direction. However, the present invention can be also applied to a printer including an ink-jet head movable forward and backward in the main scanning direction relatively to a printing paper. In this case, when the ink ejection face of the ink-jet head is to be cleaned, the ink-jet head is moved to a predetermined cleaning position. The positions, the directions of movement, and so on, of a brush and a wiper blade are adjusted so that the brush and the wiper blade can clean the ink ejection face of the ink-jet head being kept at the cleaning position. In the case of such a movable ink-jet head, there may be no necessity of providing a mechanism for moving up and down the ink-jet head, a mechanism for moving the wiper blade, and the like. For example, when the ink-jet head is horizontally movable forward and backward in the main scanning direction, a wiper blade may be fixed at a proper position within the region of the movement of the ink-jet head such that the contact face of the wiper blade is positioned at the same level as the nozzle face of the ink-jet head. In a cleaning operation, the ink-jet head is moved with its nozzle face being in contact with the contact face of the wiper blade.

In the above-described embodiment, when the brush 103 cleans the wiper blade 201, the brush 103 rotates in the same direction as that when the brush 103 cleans the nozzle faces 901*a*. In a modification, however, the brush 103 may rotate in the reverse direction. In this case, in FIG. 8B, the brush 103 rotates to brush down adhering matters on the wiper blade 201. Thereby, the suction units such as the suction unit 701 suck extraneous matters and ink more efficiently. In addition, the interior of the printer is prevented from being contaminated by extraneous matters and ink brushed off by the brush 103.

The present invention can be implemented as a maintenance system provided independently of the printer itself for cleaning the nozzle faces 901*a* of the ink-jet heads 901. For example, the present invention can be implemented as an ink-jet printer maintenance system including the brush unit 100, the wiper blade 201, the wiper blade table 202, the suction unit 701, the wiper blade moving mechanism 203, the movable table driving mechanism 600, the movable table 301, and the fixed table 302. Otherwise, the present invention can be implemented as an ink-jet head cleaner assembly including the above components. By furnishing various printers with such systems or assemblies, which are independent of the printers themselves, the ink ejection faces of the ink-jet heads can be kept clean in various printers.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus comprising:

an ink-jet head having an ink ejection face on which a plurality of ejection ports for ejecting ink are formed;

a brush that brushes off matters adhering to the ink ejection face, the brush comprising a plurality of bristles and a brush main body on which the plurality of bristles are fixed;

a suction unit that sucks matters brushed off by the brush;

a wiper having a contact face that is to be brought into contact with the ink ejection face to remove matters adhering to the ink ejection face;

a brush moving mechanism that moves the brush in parallel with the ink ejection face;

a wiper moving mechanism that moves the wiper in parallel with the ink ejection face with the contact face of the wiper being brought into contact with the ink ejection face;

a brush suction controller that controls the brush moving mechanism to move the brush to brush off adhering matters from the ink ejection face, and controls the suction unit to suck the adhering matters;

a wiper controller that controls the wiper moving mechanism to move the wiper with the contact face of the wiper being brought into contact with the ink ejection face; and a wiper cleaning controller that controls at least one of the brush moving mechanism and the wiper moving mechanism such that the brush and the wiper are closely positioned, and then controls the brush and the suction unit to perform a wiper cleaning operation in which matters adhering to the wiper are brushed off by the brush and the adhering matters are sucked by the suction unit.

2. The apparatus according to claim 1, wherein the brush suction controller controls the suction unit and the brush moving mechanism such that the brush passes over the plurality of ejection ports at least one time in a non-ejection period during which the ink-jet head does not eject ink for image formation, and the wiper controller controls the wiper moving mechanism such that the contact face of the wiper passes over the plurality of ejection ports at least one time after the brush moving mechanism makes the brush pass over the plurality of ejection ports the last time and before the non-ejection period ends.

3. The apparatus according to claim 1, further comprising a rotary drive mechanism that drives the brush main body to rotate so that the bristles sweep the ink ejection face when the brush opposes to the ink ejection face.

4. The apparatus according to claim 3, wherein a plurality of suction holes are formed on a surface of the brush main body, and the suction unit sucks adhering matters brushed off from the ink ejection face by the bristles, through the suction holes formed on the brush main body.

5. The apparatus according to claim 1, wherein the wiper cleaning controller controls the brush and the suction unit to perform the wiper cleaning operation after the brush and the wiper are moved so as to be positioned apart from the ink ejection face.

6. The apparatus according to claim 5, wherein the wiper cleaning controller controls the brush and the suction unit to perform the wiper cleaning operation in an ejection period in which the ink-jet head ejects ink.

7. The apparatus according to claim 5, wherein the wiper cleaning controller controls the brush and the suction unit to perform the wiper cleaning operation before the wiper is moved according to the control of the wiper controller.

8. The apparatus according to claim 5, wherein the wiper cleaning controller controls the brush and the suction unit to perform the wiper cleaning operation after the wiper is moved according to the control of the wiper controller.

9. The apparatus according to claim 1, further comprising a rotary drive mechanism that makes the brush main body rotate so that the bristles sweep the contact face of the wiper when the brush and the wiper are closely positioned in the wiper cleaning operation.

10. The apparatus according to claim 1, wherein the brush moving mechanism and the wiper moving mechanism comprise a table on which both of the brush and the wiper are disposed and which moves in parallel with the ink ejection face, and a table driving mechanism that moves the table in parallel with the ink ejection face.

11. An ink-jet recording apparatus comprising:

an ink-jet head having an ink ejection face on which a plurality of ejection ports for ejecting ink are formed;

a brush that brushes off matters adhering to the ink ejection face, the brush comprising a plurality of bristles and a brush main body on which the plurality of bristles are fixed;

a suction unit that sucks matters brushed off by the brush;

a wiper having a contact face that is to be brought into contact with the ink ejection face to remove matters adhering to the ink ejection face;

a brush moving mechanism that moves the brush in parallel with the ink ejection face;

a wiper moving mechanism that moves the wiper in parallel with the ink ejection face with the contact face of the wiper being brought into contact with the ink ejection face;

a brush suction controller that controls the brush moving mechanism to move the brush to brush off adhering matters from the ink ejection face, and controls the suction unit to suck the adhering matters; and a wiper controller that controls the wiper moving mechanism to move the wiper with the contact face of the wiper being brought into contact with the ink ejection face, wherein the brush moving mechanism and the wiper moving mechanism comprise a table on which both of the brush and the wiper are disposed and which moves in parallel with the ink ejection face; a table driving mechanism that moves the table in parallel with the ink ejection face; and an on-table moving mechanism that moves at least one of the brush and the wiper on the table so that the brush relatively gets near to or away from the wiper.

* * * * *